US011583072B2

(12) United States Patent
Brincat et al.

(10) Patent No.: US 11,583,072 B2
(45) Date of Patent: Feb. 21, 2023

(54) STORAGE DEVICE FOR CONTAINING PERSONAL OR OTHER ITEMS AT THE BEACH OR OTHER LOCATION

(71) Applicants: Thomas Brincat, College Point, NY (US); Patricia Demartini, College Point, NY (US)

(72) Inventors: Thomas Brincat, College Point, NY (US); Patricia Demartini, College Point, NY (US)

( * ) Notice: Subject to any disclaimer, the term of this patent is extended or adjusted under 35 U.S.C. 154(b) by 0 days.

(21) Appl. No.: 17/080,411

(22) Filed: Oct. 26, 2020

(65) Prior Publication Data

US 2022/0000260 A1 Jan. 6, 2022

Related U.S. Application Data

(60) Provisional application No. 62/925,517, filed on Oct. 24, 2019.

(51) Int. Cl.

| | |
|---|---|
| ***E04H 15/00*** | (2006.01) |
| ***A47B 43/00*** | (2006.01) |
| ***A47B 47/00*** | (2006.01) |
| *E04H 15/48* | (2006.01) |

(52) U.S. Cl.

CPC ..... *A47B 47/0083* (2013.01); *A47B 47/0041* (2013.01); *A47B 2220/0036* (2013.01); *E04H 15/003* (2013.01); *E04H 15/48* (2013.01)

(58) Field of Classification Search

CPC ..... A47B 47/0083; A47B 47/0041; A47B 2220/0036; E04H 15/003; E04H 15/48

See application file for complete search history.

(56) References Cited

U.S. PATENT DOCUMENTS

| | | | | |
|---|---|---|---|---|
| 1,629,362 | A * | 5/1927 | Robert | A47B 43/04 206/291 |
| 2,244,887 | A | 6/1941 | Manley | |
| 2,619,101 | A * | 11/1952 | McGerry | E04H 15/003 135/117 |
| 2,905,513 | A | 9/1959 | Kane | |
| 4,863,075 | A | 9/1989 | Romer | |
| 4,867,513 | A | 9/1989 | Choi | |
| 4,887,837 | A | 12/1989 | Bonewicz, Jr. et al. | |
| 5,090,526 | A | 2/1992 | Jacober | |
| 5,595,429 | A | 1/1997 | Kennedy | |
| 5,660,403 | A | 8/1997 | O'Neill et al. | |

(Continued)

OTHER PUBLICATIONS

"Ozark Trail 3-Shelf Collapsible Cabinet" found at https://www.amazon.com.

*Primary Examiner* — Kimberley S Wright

(74) *Attorney, Agent, or Firm* — The Patent Professor; John Rizvi, P.A.

(57) ABSTRACT

A storage device is provided including a support frame having a plurality of elongated support members and a stiffening bracket carried by the support members. An enclosure may be carried by the support frame. The enclosure may be foldable and have a fabric construction and may be detachably attached to the support frame. A plurality of closeable storage compartments may be provided in the enclosure. The storage compartments may contain items such as towels, clothes, shoes, lotion and other items used by a beachgoer or other user, at the beach or other location.

14 Claims, 12 Drawing Sheets

(56) References Cited

U.S. PATENT DOCUMENTS

| | | | | |
|---|---|---|---|---|
| 5,678,904 | A * | 10/1997 | Hung | A47B 43/04 135/121 |
| 5,810,457 | A | 9/1998 | Felsenthal et al. | |
| 5,957,310 | A | 9/1999 | Mitchell | |
| 6,131,925 | A | 10/2000 | Weldon | |
| 6,142,589 | A * | 11/2000 | Wang | A47B 47/00 312/3 |
| 6,871,452 | B2 * | 3/2005 | Berg | A01G 9/16 52/273 |
| 6,988,737 | B1 | 1/2006 | Clark | |
| 7,963,530 | B1 | 6/2011 | Garcia | |
| 8,002,126 | B1 | 8/2011 | Drum | |
| 8,276,999 | B2 * | 10/2012 | Hassman | A47B 43/00 108/158.11 |
| 8,465,031 | B2 | 6/2013 | Coghill, Jr. | |
| 9,259,082 | B2 | 2/2016 | Barre et al. | |
| 9,683,385 | B1 * | 6/2017 | Huesdash | E04H 15/48 |
| 2004/0206013 | A1 * | 10/2004 | Berg | A01G 9/16 52/63 |
| 2006/0022559 | A1 | 2/2006 | Mallen | |
| 2010/0013363 | A1 | 1/2010 | Wang | |
| 2010/0133217 | A1 | 6/2010 | Wang | |
| 2010/0276241 | A1 | 11/2010 | Malone | |
| 2011/0006654 | A1 * | 1/2011 | Hassman | A47B 43/00 312/265.5 |
| 2011/0203629 | A1 * | 8/2011 | Smith | E04H 15/001 135/121 |
| 2017/0247905 | A1 * | 8/2017 | Topping | E04H 15/46 |
| 2018/0057031 | A1 | 3/2018 | Kinnee | |

* cited by examiner

STORAGE DEVICE FOR CONTAINING PERSONAL OR OTHER ITEMS AT THE BEACH OR OTHER LOCATION

CROSS-REFERENCE TO RELATED APPLICATIONS

This application claims the benefit of U.S. Provisional Patent Application No. 62/925,517, filed on Oct. 24, 2019, which is incorporated herein by reference in its entirety.

FIELD OF THE INVENTION

The present invention relates generally to beach items, and more particularly, to a storage device which is suitable to facilitate storage of multiple items such as towels, clothes, shoes and other personal items used by a beachgoer or other subject, at the beach or other location.

BACKGROUND OF THE INVENTION

People have enjoyed spending time at the beach for centuries. Beaches provide an opportunity for sunbathing, exercise, fishing, relaxing, surfing, and other activities for millions of people worldwide. As a testimony to their popularity, the beaches around the world are often punctuated with condominiums and other beachfront properties. Furthermore, travelers and tourist may travel domestically or internationally just to visit beaches of their interest and to enjoy a relaxing vacation or off-time experience.

Many beachgoers enjoy spending several hours or an entire day at a time at the beach. In order to spend the time at the beach with relative comfort and entertainment, the beachgoers may bring along numerous supplies such as, but not limited to, towels, chairs, beach umbrellas, coolers, thermoses, lotions, sunglasses, books, cards or other games, as well as cellphones, tablets, headphones, cameras, and other electronic devices. Often, beachgoers may also bring with them food such as fruit, snacks, sandwiches, etc. In addition, they may need a place to store their clothes, shoes, keys, wallet, purse, cap, and/or other everyday items while enjoying a time at the beach.

In practice, it is common for beachgoers to have limited space or area in which to store all the aforementioned items. Furthermore, some items should be kept in the shade as they may deteriorate if left in the sun. In addition, some items may be in greater risk of being stolen by people passing by. For these reasons mainly, beachgoers are often forced to hide items as they possibly can, considering the limited resources available; for instance, objects may be hidden one inside the other (e.g., car keys inside a shoe), one by the other (purse covered by an item of clothing), and/or underneath a towel, to name a few examples. Once items are hidden, beachgoers will typically check every once in a while that the items remain out of sight or in the shade. Having to think of ways to hide items from eyesight or sunlight, and periodically check whether the items remain hidden, may increase stress, and thus adversely affect the relaxation experienced by the beachgoer while spending time at the beach. Furthermore, storing or hiding items one inside the other, etc. may increase the chances of the items becoming inadvertently misplaced and lost, stolen, wet or soiled.

Some solutions have been developed for storing personal items while at the beach. However, these solutions are often bulky and difficult to transport or carry. Other times, beach storage solutions are too small and do not allow for storage of a relatively wide variety of everyday items, food, and other objects such as those mentioned heretofore.

Accordingly, there remains a need for a solution to at least one of the aforementioned problems. For example, there is an established need for a beach storage solution which is suitable to facilitate storage of multiple items such as towels, clothes, shoes, and other items used by a beachgoer.

SUMMARY OF THE INVENTION

The present invention is directed to a storage device which is suitable to facilitate storage of multiple items such as towels, clothes, shoes, lotion and other items used by a beachgoer or other user, at the beach or other location. The storage device may include a support frame. An enclosure may be provided on the support frame. The enclosure may have a fabric construction and may include a plurality of closeable storage compartments in which the items may be placed. The support frame may include a plurality of elongated support members. Insertion tips may terminate the lower ends of the respective support members for insertion into the sand on a beach. The support members may extend through support member openings in the respective corners of the enclosure. A stiffening bracket may connect the support members. A bracket attachment member may attach the enclosure to the support members. The storage device can be readily assembled for use and disassembled for ease in transport and/or storage.

In a first implementation of the invention, a storage device, suitable to facilitate storage of one or more items of a user at the beach or other location, comprises a support frame and an enclosure. The support frame comprises a plurality of elongated support members and a stiffening bracket. In turn, the enclosure is foldable and attachable to the support frame and comprises one or more storage compartments formed therein. The storage device is configured to adopt an assembled configuration in which the elongated support members are attached to the enclosure, and further in which the stiffening bracket disconnectably interconnects the elongated support members and rigidly maintains the elongated support members in a spaced-apart configuration from each other. The elongated support members in the spaced-apart configuration maintain the enclosure in a deployed position in which the one or more storage compartments provide respective one or more spaces for item storage.

In a second aspect, the elongated support members may be arranged at a periphery of the one or more storage compartments when the storage device is in the assembled configuration.

In another aspect, the elongated support members may be coupled to a periphery of the enclosure when the storage device is in the assembled configuration.

In another aspect, each elongated support member may extend through a respective pair of support member openings arranged at the periphery of the enclosure when the storage device is in the assembled configuration.

In another aspect, the elongated support members may be arranged vertically and parallel to one another when the storage device is in the assembled configuration.

In yet another aspect, the elongated support members may include a respective tapered insertion tip at a lower end thereof.

In another aspect, when the storage device is in the assembled configuration, the enclosure may be arranged beneath the stiffening bracket.

In another aspect, when the storage device is in the assembled configuration, a top of the enclosure may be disconnectably suspended from the stiffening bracket.

In another aspect, the stiffening bracket may include a hub and a plurality of pivotable bracket members. Each pivotable bracket member may be pivotably connected to a respective elongated support member of the plurality of elongated support members. The hub may be disconnectably connectable to the plurality of pivotable bracket members. When the storage device is in the assembled configuration, the pivotable bracket members may be pivoted towards the hub and the hub may be disconnectably connected to the pivotable bracket members.

In another aspect, when the storage device is in the assembled configuration, each pivotable bracket member may be pivotally arranged generally perpendicular to the respective elongated support member and the stiffening bracket may be arranged generally perpendicular to the plurality of elongated support members.

In another aspect, each pivotable bracket member may be configured to adopt a storage position in which the pivotable bracket member is pivotally arranged in a generally parallel and side-by-side relationship with the respective elongated support member.

In another aspect, when the storage device is in the assembled configuration, a top of the enclosure may be disconnectably suspended from the hub.

In another aspect, the plurality of elongated support members may include four elongated support members, and the plurality of pivotable bracket members may include four pivotable bracket members. Each bracket member of the four pivotable bracket members may be pivotably carried by a respective elongated support member of the four elongated support members. The hub may be X-shaped.

In another aspect, when the storage device is in the assembled configuration, the stiffening bracket may be detachably mounted to respective top ends of the elongated support members.

In another aspect, the plurality of elongated support members may include four elongated support members, and the stiffening bracket may include a pair of elongated bracket arms arranged in an X-shaped configuration. Opposite outer ends of the bracket arms may be detachably mounted to respective top ends of the four elongated support members.

In another aspect, the one or more storage compartments may include a plurality of storage compartments, and the storage device may further include a plurality of shelf panels arranged within the enclosure and separating a plurality of storage compartments from each other.

In another aspect, the storage device may be configured to adopt a storage configuration in which the elongated support members are not interconnected by the stiffening bracket and are closer to one another than in the assembled configuration.

In yet another aspect, when the storage device is arranged in the storage configuration, the elongated support members may be attached to the enclosure and the enclosure may be collapsed.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a storage device or beach caddy which is suitable to facilitate storage of multiple items such as towels, clothes, shoes, lotion and other items used by a beachgoer or other user, at the beach or other location.

Figure 1:
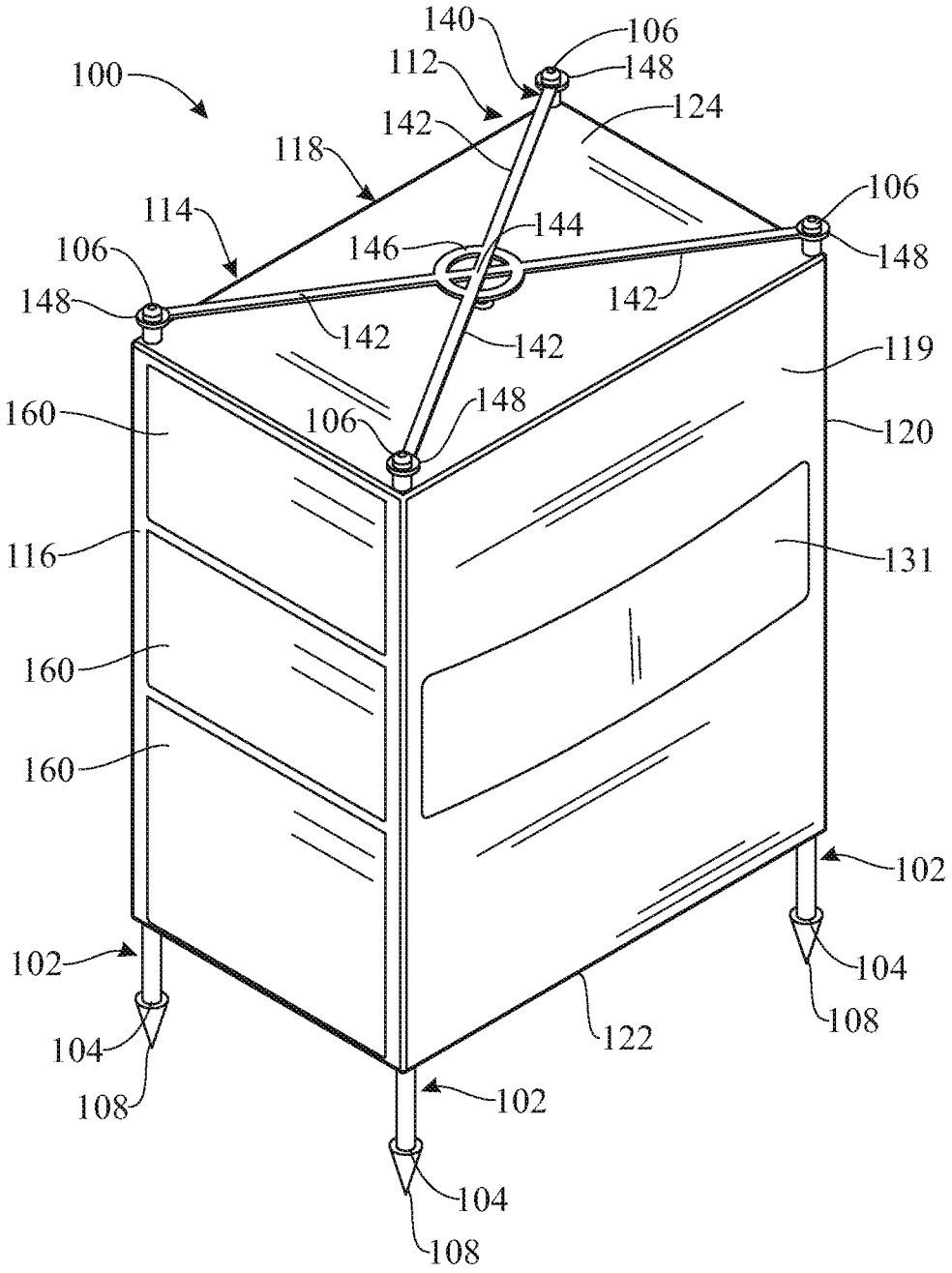
FIG. 1 presents a top front right-side isometric view of a storage device or beach caddy in accordance with an illustrative embodiment of the present invention, with front compartment panels shown in closed position.
Figure 4:
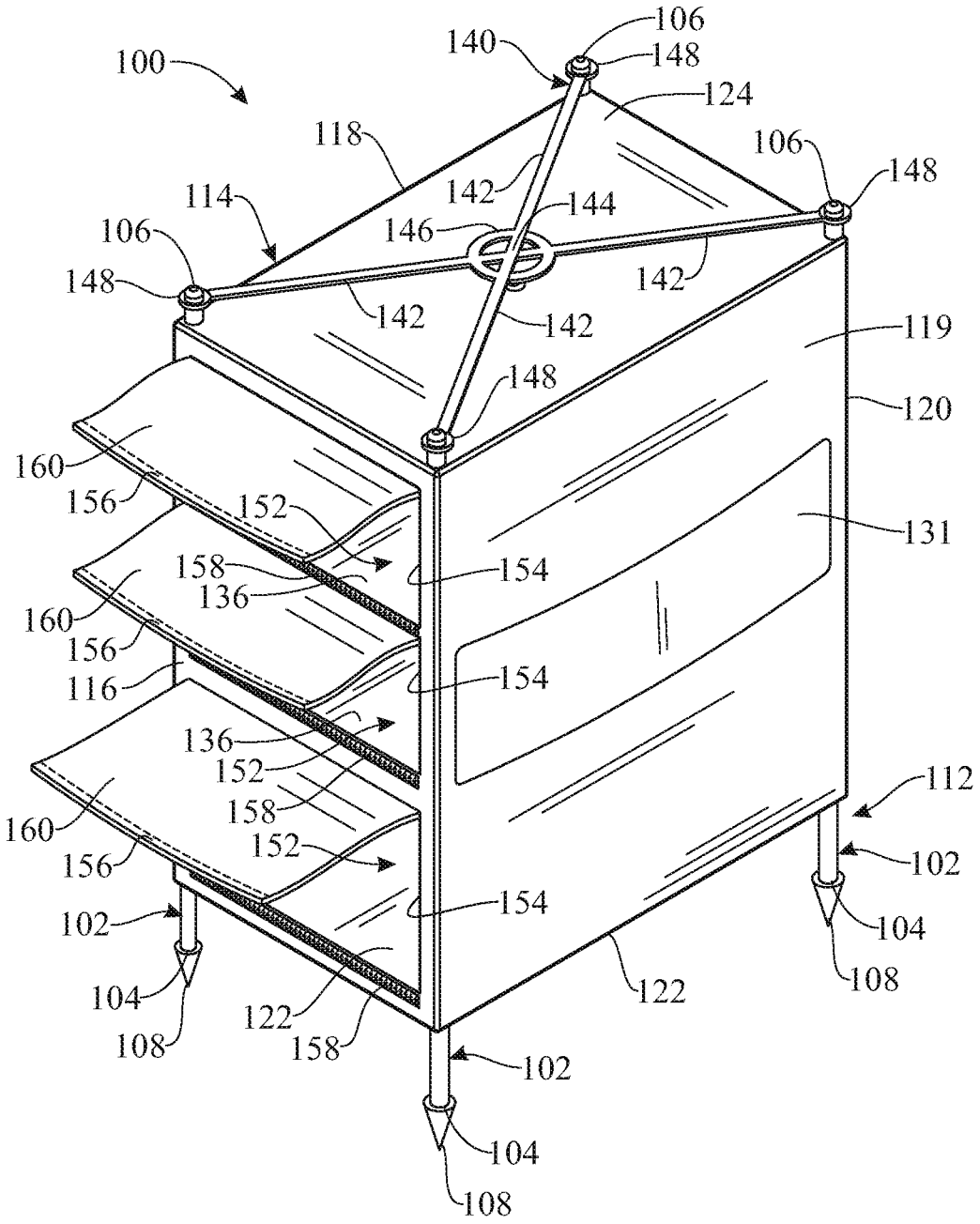
FIG. 4 presents a top front right-side isometric view of the beach caddy of FIG. 1, with the respective storage compartments empty and the front compartment panels in an open position.
Figure 5:
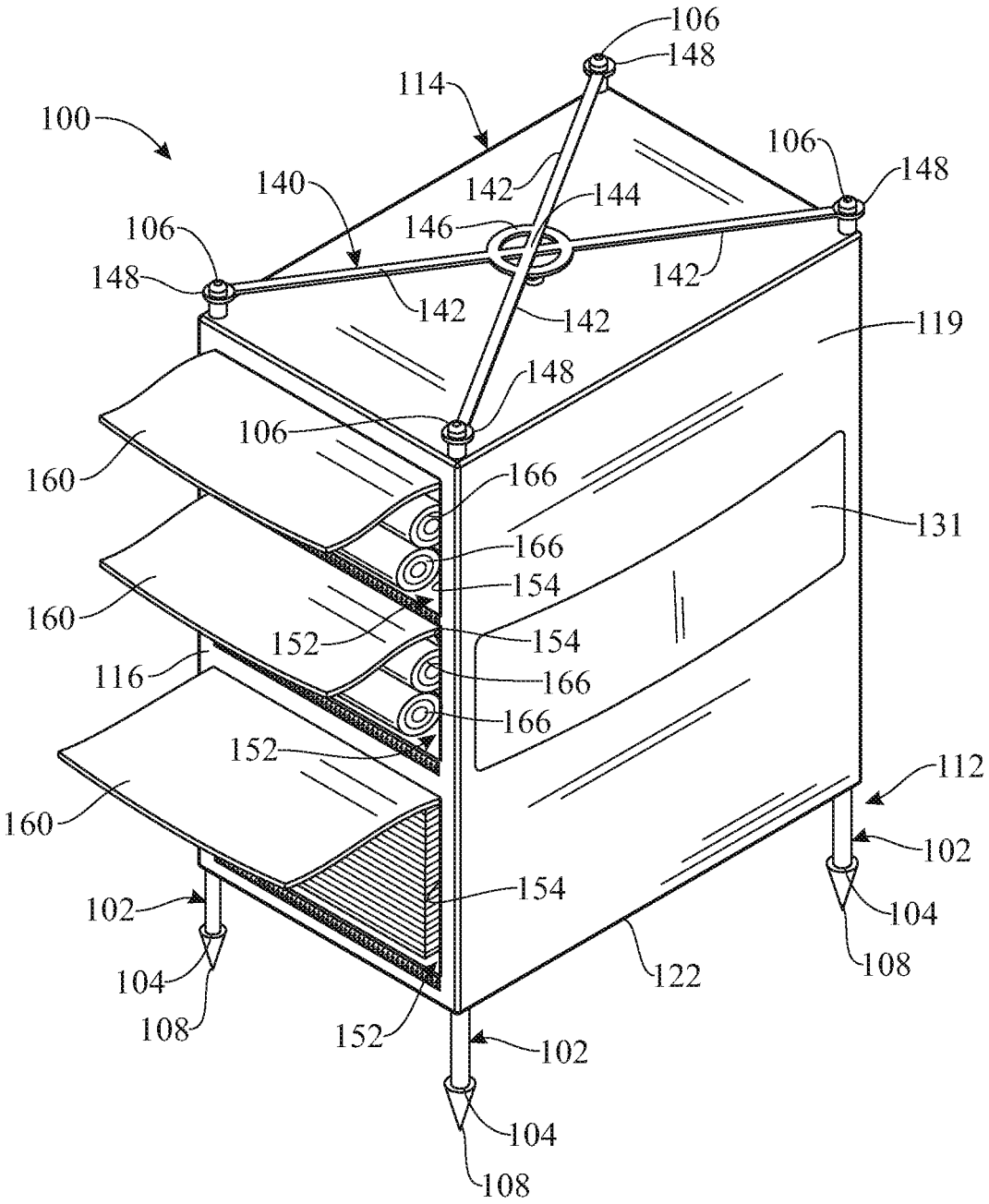
FIG. 5 presents a top front right-side isometric view of the beach caddy of FIG. 1, with the respective front compartment panels in an open position, and towels and other items placed in the compartments.
Figure 6:
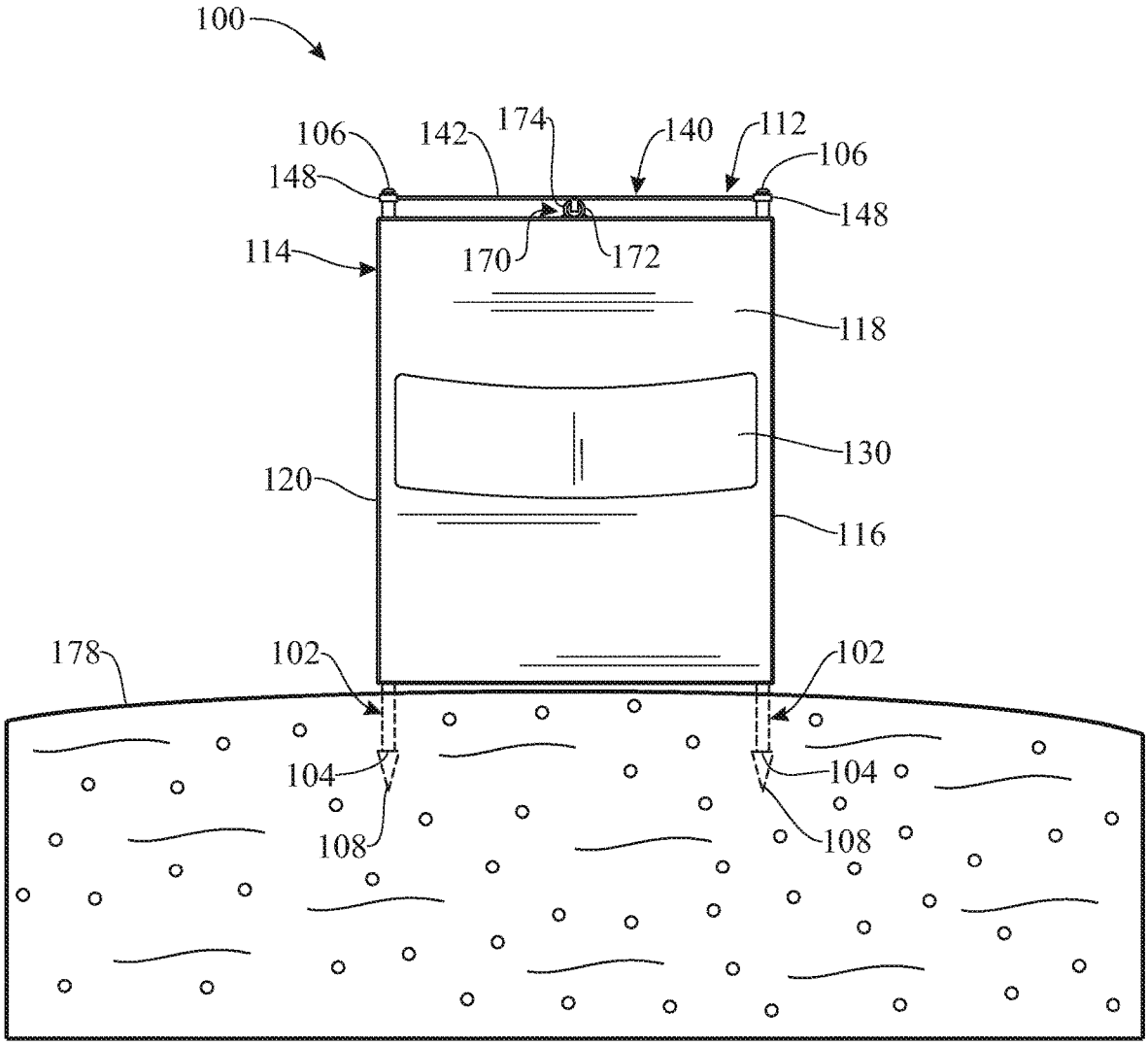
FIG. 6 presents a left side elevation view of the beach caddy of FIG. 1, with the support members of the support frame inserted in sand in typical deployment and application of the beach caddy.

Referring initially to FIG. 1, an illustrative embodiment of the storage device is generally indicated by reference numeral 100 and referred to as 'beach caddy'. The beach caddy 100 may include a support frame 112. An enclosure 114 may be provided on, carried by, or supported by the support frame 112. As illustrated in FIGS. 4 and 5, a plurality of storage compartments 152 may be provided in the enclosure 114, allowing to store items in different, separate spaces; for instance, the enclosure 114 depicted herein includes three storage compartments 152 arranged in vertical registration or stacked with one another. As illustrated in FIG. 6 and will be hereinafter described, the beach caddy 100 may be easily assembled and deployed on sand 178 at a beach or other location. As illustrated in FIG. 5, various items 166 such as, but not limited to, towels, coolers, thermoses, lotions, sunglasses, books, cards or other games, cellphones, tablets, headphones, cameras, food, clothes, shoes, keys, wallet, purses, caps, hats, etc. may be contained in the storage compartments 152 and easily viewed and accessed for use by a beachgoer.

Figure 3:
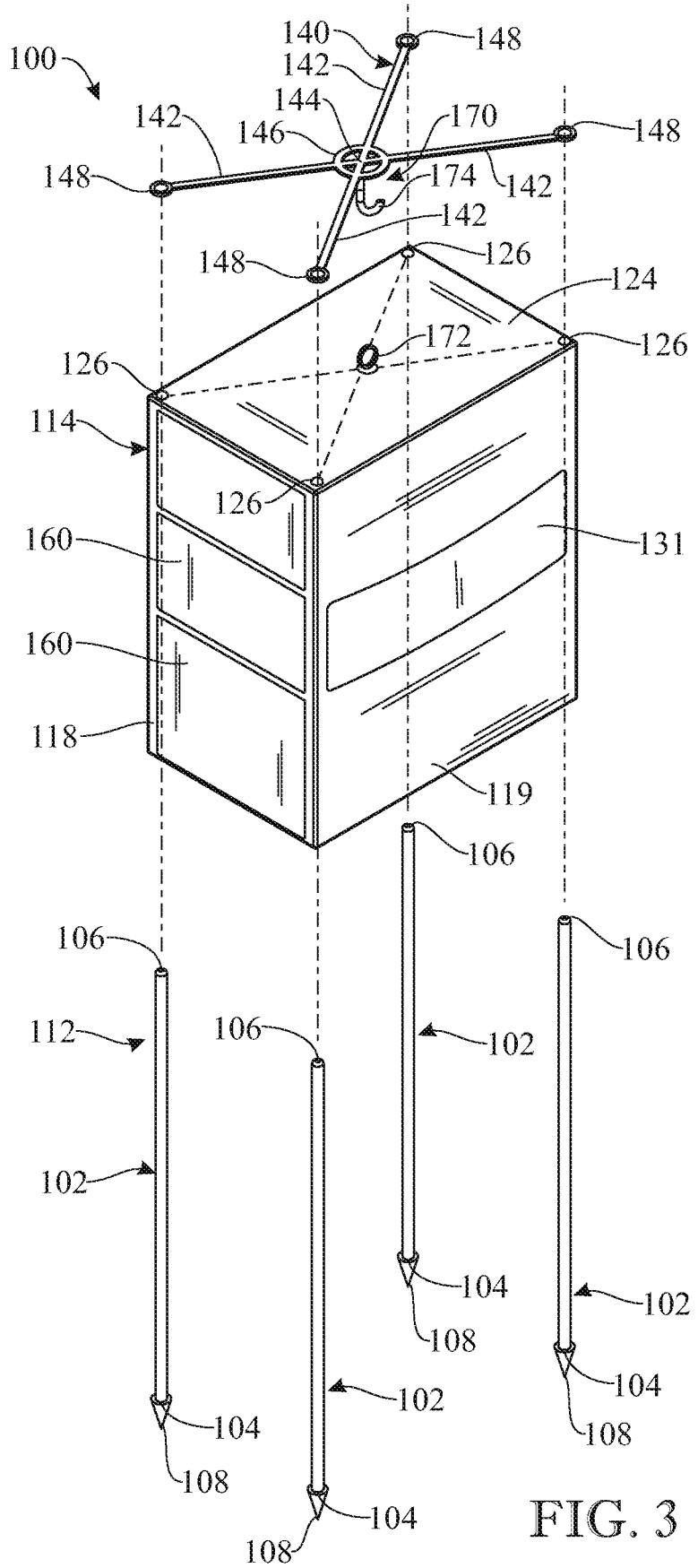
FIG. 3 presents an exploded, top front right-side isometric view of the beach caddy of FIG. 1.

As illustrated in FIG. 3, in some embodiments, the support frame 112 of the beach caddy 100 may include a plurality of elongated support members 102, which may be formed as a rod, pole, stick or the like and are preferably made of lightweight plastic or metal (e.g., aluminum). Each support member 102 may have a lower end 104 and an upper end 106. A tapered or sharpened insertion tip 108 may terminate the lower end 104 of each support member 102, providing a sand spike which facilitates insertion of the lower end 104 into the sand 178 (FIG. 6), typically as will be hereinafter described. In some embodiments, the insertion tip 108 may be threaded.

With continued reference to FIG. 3, a rigid, stiffening bracket 140 may connect to the support members 102 and connect the support members 102 to each other in order to provide rigidity to the support frame 112 or increase rigidity of the support frame 112. In some embodiments, the stiffening bracket 140 may be X-shaped, including a pair of elongated bracket arms 142 which may intersect at an arm junction 144 forming an X-shape. A reinforcing flange 146 may stabilize the arm junction 144, such as at or near the arm junction 144, as shown. In some embodiments, bracket rings 148, clamps, clips or other connectors configured to secure to the support members 102 may terminate the respective outer ends of the bracket arms 142, at outer ends of the X-shape formed by the bracket arms 142.

As illustrated in FIGS. 1 and 3, the stiffening bracket 140 may be attached to the support members 102 by inserting the upper ends 106 of the respective support members 102 through the respective bracket rings 148 on the bracket arms 142 of the stiffening bracket 140. The upper end 106 of each support member 102 may be removably fitted, such as snap-fitted, in the corresponding bracket ring 148. In other embodiments, alternative or additional techniques known by those skilled in the art may be used to removably attach or secure the support members 102 to the stiffening bracket 140.

Further alternative embodiments are contemplated in which the stiffening bracket 140 may include other elongated members in addition to or instead of the X-shaped aim arrangement. For instance and without limitation, the stiffening bracket may include four elongated segments or members forming a rectangle, with a respective bracket ring 148 or other attachment mechanism carried or provided at each of the four corners of the rectangle in order to connect the four corners to the four support members 102, respectively.

With continued reference to FIG. 1, the enclosure 114 may have a fabric construction such as rip-stop nylon, for example and without limitation. In some embodiments, the enclosure 114 may include a front enclosure panel 116 and a rear enclosure panel 120 (also shown in FIG. 7) disposed in parallel, spaced-apart relationship with the front enclosure panel 116. A pair of parallel, spaced-apart, left and right side enclosure panels 118 and 119, respectively, may extend between the front enclosure panel 116 and the rear enclosure panel 120. A floor or bottom enclosure panel 122, best shown in FIG. 2, and a top enclosure panel 124, best shown in FIG. 1, may extend between the front enclosure panel 116, the rear enclosure panel 120 and the left and right side enclosure panels 118 and 119, such that the six panels jointly form a generally rectangular enclosure.

In some embodiments, at least one see-through window may be comprised in the enclosure 114 to allow viewing at least one of the storage compartments 152; in other words, one or more of the storage compartments 152 may be facing one or more see-through windows provided in the enclosure 114 to allow an outside observer to view the contents of these one or more storage compartments 152 therethrough. In some embodiments, one or more of the storage compartments 152, instead, may not face any see-through windows on the enclosure 114, thus allowing these one or more storage compartments 152 to remain hidden from outside view. For instance, in the present embodiment, the central storage compartment 152 is visible while the upper and lower storage compartments 152 are hidden; more specifically, the central storage compartment 152 is visible through a left side enclosure window 130 formed on the left side enclosure panel 118 (FIG. 2) and a right side enclosure window 131 formed on the right side enclosure panel 119 (FIG. 1), while the enclosure 114 includes no see-through windows facing the upper and lower storage compartments 152.

Figure 7:
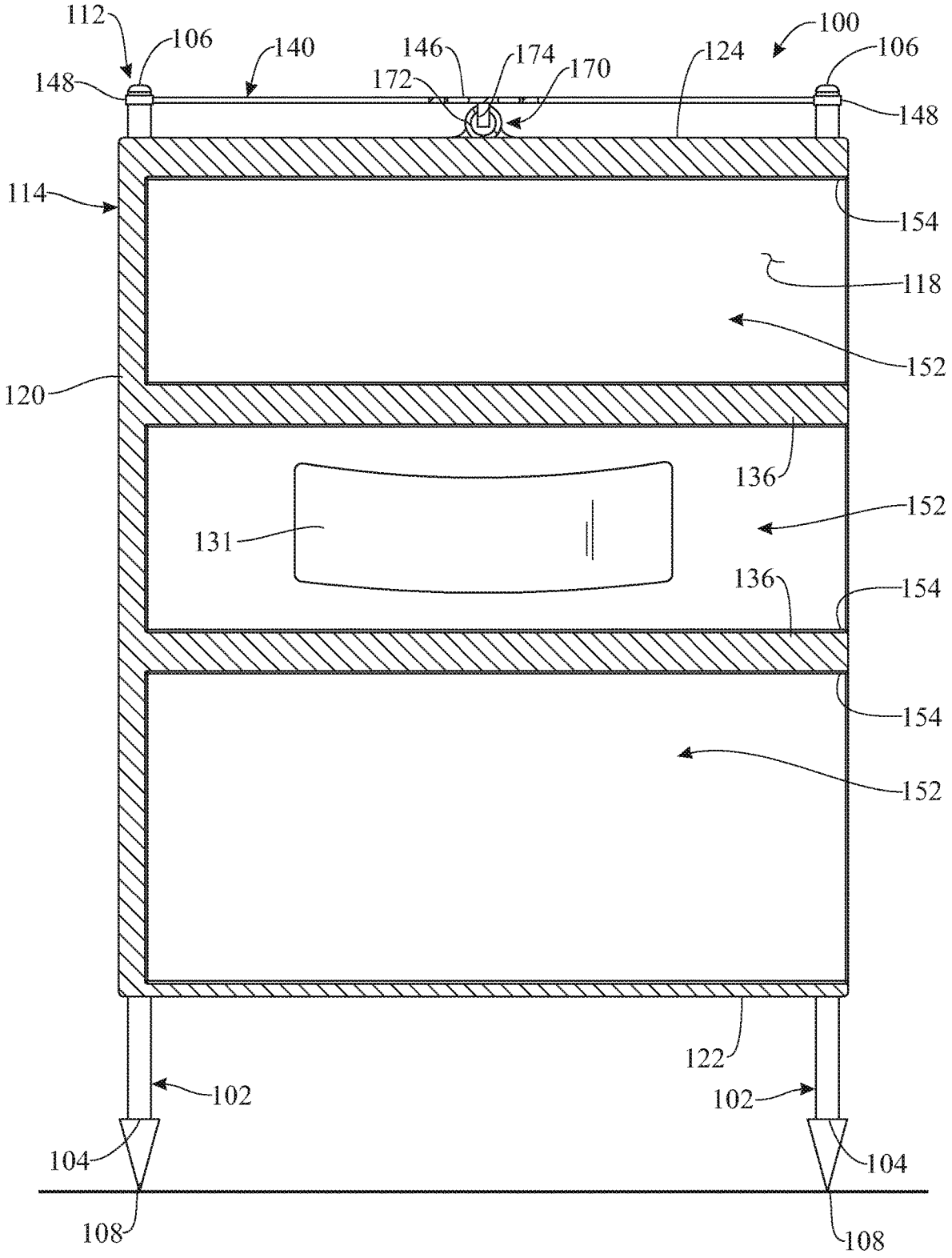
FIG. 7 presents a cross-sectional, left side elevation view of the beach caddy of FIG. 1, the cross-section taken along section plane 7-7 indicated in FIG. 2, the view illustrating the storage compartments of the beach caddy separated by internal, intermediate shelf panels.

As illustrated in FIG. 7, at least one intermediate or shelf panel 136 may extend between the front enclosure panel 116, the left side enclosure panel 118, the right side enclosure panel 119, and the rear enclosure panel 120. Each shelf panel 136 may separate adjacent storage compartments 152 from each other in the enclosure 114. In some embodiments, at least two shelf panels 136 may divide the interior of the enclosure 114 into at least three storage compartments 152; for instance, the present embodiment includes two shelf panels 136 that divide the interior of the enclosure 114 into three storage compartments 152, as illustrated. In various embodiments, however, any number of shelf panels 136 may divide the interior of the enclosure 114 into any corresponding number of storage compartments 152. The shelf panels 136 may be stitched and/or otherwise attached to the front enclosure panel 116, the left and right side enclosure panels 118 and 119, and the rear enclosure panel 120.

Figure 2:
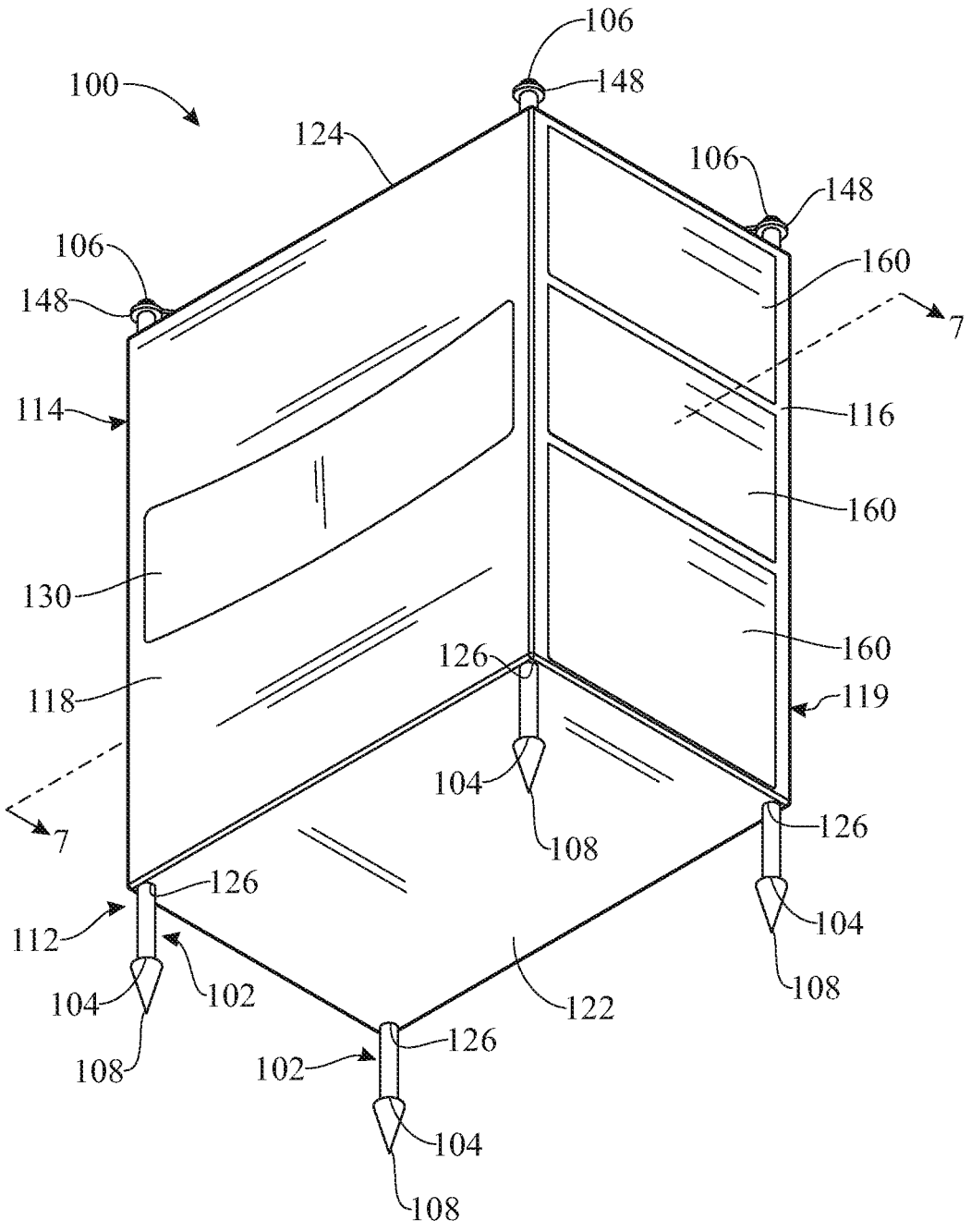
FIG. 2 presents a bottom rear left-side isometric view of the beach caddy of FIG. 1.

As illustrated in FIGS. 4, 5 and 7, each storage compartment 152 may have a compartment opening 154 which opens to the front enclosure panel 116. A compartment panel 160 may extend from the front enclosure panel 116 over each corresponding compartment opening 154. The compartment panel 160 is preferably flexible and can be made of the same material as the remainder of the enclosure 114. As illustrated in FIGS. 1-3, each compartment panel 160 may normally extend in front of its corresponding compartment opening 154 to close the compartment opening 154 and conceal the items 166 in the storage compartment 152 and prevent entry of sand into the storage compartment 152. In some embodiments, such as the present embodiment, the compartment panels 160 in the extended or closed position are more specifically arranged hanging downwardly, such that gravity contributes to maintain the compartment panels 160 in the closed position. The compartment panels 160 may be secured in the closed position by one or more respective fasteners which may include one or more magnets, snap fasteners, hook-and-loop fasteners, etc. For instance, in the present embodiment, each compartment panel 160 is secured in the closed position by a respective fastener comprising a first fastener portion 156 carried by the compartment panel 160 and a second fastener portion 158 carried by the enclosure 114 along an edge of the front enclosure panel 116 facing the respective compartment opening 154. For instance and without limitation, the first fastener portion 156 may be one of a hook portion and a loop portion of a hook-and-loop fastener and the second fastener portion 158 may be the other of a hook portion and a loop portion of a hook-and-loop fastener. As illustrated in FIGS. 4 and 5, each compartment panel 160 may be selectively moved (e.g., raised) to expose its corresponding compartment opening 154 and facilitate placement of the items 166 into or removal of the items 166 from the corresponding storage compartment 152.

As mentioned heretofore, the enclosure 114 is carried or supported by the support frame 112. In some embodiments, the enclosure 114 is also attached to the support frame 112; in different embodiments, said attachment may be carried out in various ways. For instance, as illustrated in FIGS. 2 and 3, registering pairs of support member openings 126 may extend through the bottom enclosure panel 122 and the top enclosure panel 124 at respective corners of the enclosure 114. Each support member 102 of the support frame 112 may be extended through a respective pair of vertically-registering support member openings 126. The upper ends 106 of the support members 102, which, as shown in FIG. 1, protrude upwardly and outwardly of the support member openings 126 in the top enclosure panel 124, may be extended through the respective bracket rings 148 on the stiffening bracket 140. Alternatively or additionally, the stiffening bracket 140 may be attached to the top enclosure panel 124 of the enclosure 114, such as by one or more bracket attachment members 170. For instance, as shown in FIG. 3, the present embodiment includes a single bracket attachment member 170 connecting the aim junction 144 of the stiffening bracket 140 to the top enclosure panel 124. The bracket attachment member 170 can include an attachment hook 174 carried by or formed integrally with the stiffening bracket 140 and an attachment ring 172 affixed, in turn, to a central area of the top enclosure panel 124. The attachment ring 172 may be hooked onto the attachment hook 174, allowing the central area of the top enclosure panel 124 to be suspended from the stiffening bracket 140, and more particularly, in the present embodiment, to the arm intersection or junction 144.

As illustrated in FIGS. 3-7, in typical application, the beach caddy 100 may be assembled and deployed on sand 178 (FIG. 6) on a beach or other recreational area. Various items 166 such as towels, clothes, shoes, keys, cellphones and the like (FIG. 5) may be placed in one or more of the storage compartments 152 and easily viewed and accessed for use by a beachgoer. As illustrated in FIG. 3, the beach caddy 100 may be assembled by initially inserting the elongated support members 102 of the support frame 112 through the respective pairs of registering support member openings 126 in the bottom enclosure panel 122 and the top enclosure panel 144 of the enclosure 114. Assembly of the support frame 112 may be completed by inserting the upper ends 106 of the respective support members 102 into the respective bracket rings 148 on the bracket aims 142 of the stiffening bracket 140. The enclosure 114 may be attached to the stiffening bracket 140 by securement of the bracket attachment member 170 as described heretofore.

As illustrated in FIG. 6, the assembled beach caddy 100 may be deployed in an upward-standing position on the sand 178 by inserting the insertion tips 108 on the lower ends 104 of the respective support members 102 into the sand 178. The bracket attachment member 170 may suspend the enclosure 114 from the stiffening bracket 140 of the support frame 112 as the support members 102 maintain the shape of the enclosure 114 by having the support members 102 extend through the enclosure 114 while the stiffening bracket 140 maintains the four support members 102 in a four-corner, spaced apart arrangement, which maintains the front, left side, right side and rear panels 116, 118, 119 and 120 of the enclosure 114 at a predetermined separation with one another allowing the enclosure 114 to substantially retain its predetermined shape. As can be seen, for instance, in FIGS. 4 and 7, the support members 102 are coupled to a periphery of the enclosure 114 (i.e. to the corners of the enclosure 114) and also arranged at a periphery of the storage compartments 152, which minimizes interference between the support members 102 and the storage compartments 152 and maximizes storage space, and also contributes to maximizing the ability of the support frame 112 to deploy and tension the enclosure 114 and therefore to maximize the storage space.

Once the beach caddy 100 is deployed, one or more of the items 166 may be placed in each storage compartment 152 by lifting the corresponding compartment panel 160 to expose the storage compartment 152 and inserting the item 166 through the compartment opening 154 into the storage compartment 152. The compartment panel 160 may be released to cover the compartment opening 154 and prevent sand from entering the storage compartment 152.

A selected item 166 may be removed from one of the storage compartments 152 for use by lifting the compartment panel 160 of the storage compartment 152 and retrieving the item 166 from the storage compartment 152 through the compartment opening 154. The items 166 may be viewable through the side enclosure windows 130 and/or the rear enclosure windows 132 to enable a user of the beach caddy 100 to select which of the storage compartments 152 from which a selected item 166 needs to be retrieved.

After use, the items 166 may be removed from the storage compartments 152. The beach caddy 100 may be disassembled typically by removing the stiffening bracket 140 from the support members 102 of the support frame 112, and disconnecting the bracket attachment member 170 to uncouple the stiffening bracket 140 from the enclosure 114. Next, in some embodiments, the support members 102 may be removed from the pairs of registering support member openings 126 in the bottom enclosure panel 122 and top enclosure panel 124. The emptied enclosure 114 may be folded for space-efficient transport and/or storage. In turn, the elongated support members 102 may be placed adjacent to one another and require minimal storage space. In some embodiments, the elongated support members 102 may be foldable into two or more elongated segments, may be telescopic or may present other alternative length-adjustable configuration as known in the art to allow their length to be reduced to further reduce the space required for storing the beach caddy 100 when not in use. In other embodiments, the support members 102 may remain inserted through and attached to the enclosure 114 once the stiffening bracket 140 is removed, and the assembly formed by the enclosure 114 and support members 102 may collapsed by squeezing or bringing the support members 102 closer together, thereby obtaining a compressed assembly which may facilitate transportation and storage. IN some embodiments, the compressed assembly may be slid into a carrying bag for ease of transportation and storage.

The illustrations of FIGS. 8-12 show a storage device or beach caddy 200 to facilitate storage of one or more items of a user at the beach or other location, in accordance with another illustrative embodiment of the invention. Similarly to the previous embodiment, the beach caddy 200 includes a support frame 212 configured to carry an enclosure 214. The enclosure 214 is foldable and attachable to the support frame 212. In some embodiments, the enclosure 214 may be permanently attached to the support frame 212, and the enclosure 214 and support frame 212 may be collapsed jointly for storage purposes, as will be described. In other embodiments, the enclosure 214 may be non-permanently attached to the support frame 212, allowing a user to separate one from the other, such as to facilitate cleaning of either one of the enclosure 214 and the support frame 212, or to allow separate collapsing and/or storage of the enclosure 214 and the support frame 212.

Figure 8:
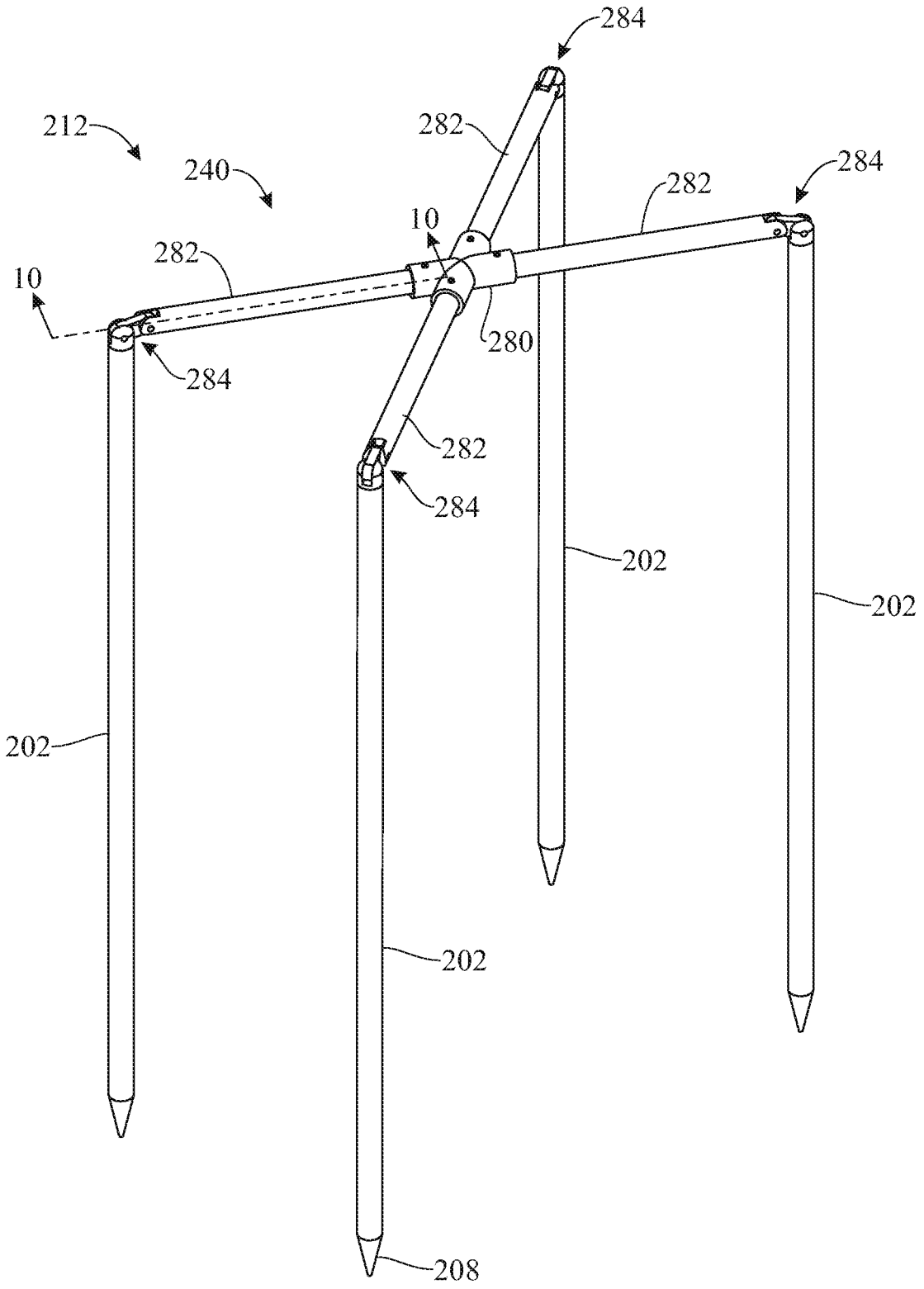
FIG. 8 presents a top isometric view of a support frame of a beach caddy in accordance with a second illustrative embodiment of the invention, the support frame including elongated support members and a stiffening bracket, the elongated support members and stiffening bracket shown in an assembled position.

With reference to FIG. 8, similarly to the previous embodiment, the support frame 212 includes a plurality of elongated support members 202 and a stiffening bracket 240, which may be selectively configured to extend between the elongated support members 202 and maintain the elongated support members 202 at a predetermined distance and location from one another when the beach caddy 200 is in an assembled configuration, as will be described hereinafter. In the present embodiment, the support frame 212 includes a connecting member or hub 280 and a plurality of pivotable bracket members 282. For example, similarly to the previous embodiment, the present embodiment specifically includes four elongated support members 202 and the hub 280 correspondingly includes four pivotable bracket members 282, wherein each bracket member 282 is pivotably carried by a respective one of the four elongated support members 202. In turn, as shown, the hub 280 of the present embodiment is a preferably rigid, single-piece, X-shaped, central connector.

As further shown in FIG. 8, each pivotable bracket member 282 is pivotably connected to a respective one of the elongated support members 202 by a respective articulated connection 284. As better shown in FIGS. 9 and 10, the articulated connection 284 may include a first pivoting connection 286 and a second pivoting connection 288. The first pivoting connection 286 pivotably connects the support member 202 to a first end 292 of a connecting link 290 about a first rotation axis 286*a*. In turn, the second pivoting connection 288 pivotably connects an opposite, second end 294 of a connecting link 290 and the pivotable bracket member 282 about a second rotation axis 288*a*, which may be parallel to the first rotation axis 286*a*, as shown. The connecting link 290 is provided to separate the first and second rotation axes 286*a* and 288*a* from one another.

Figure 9:
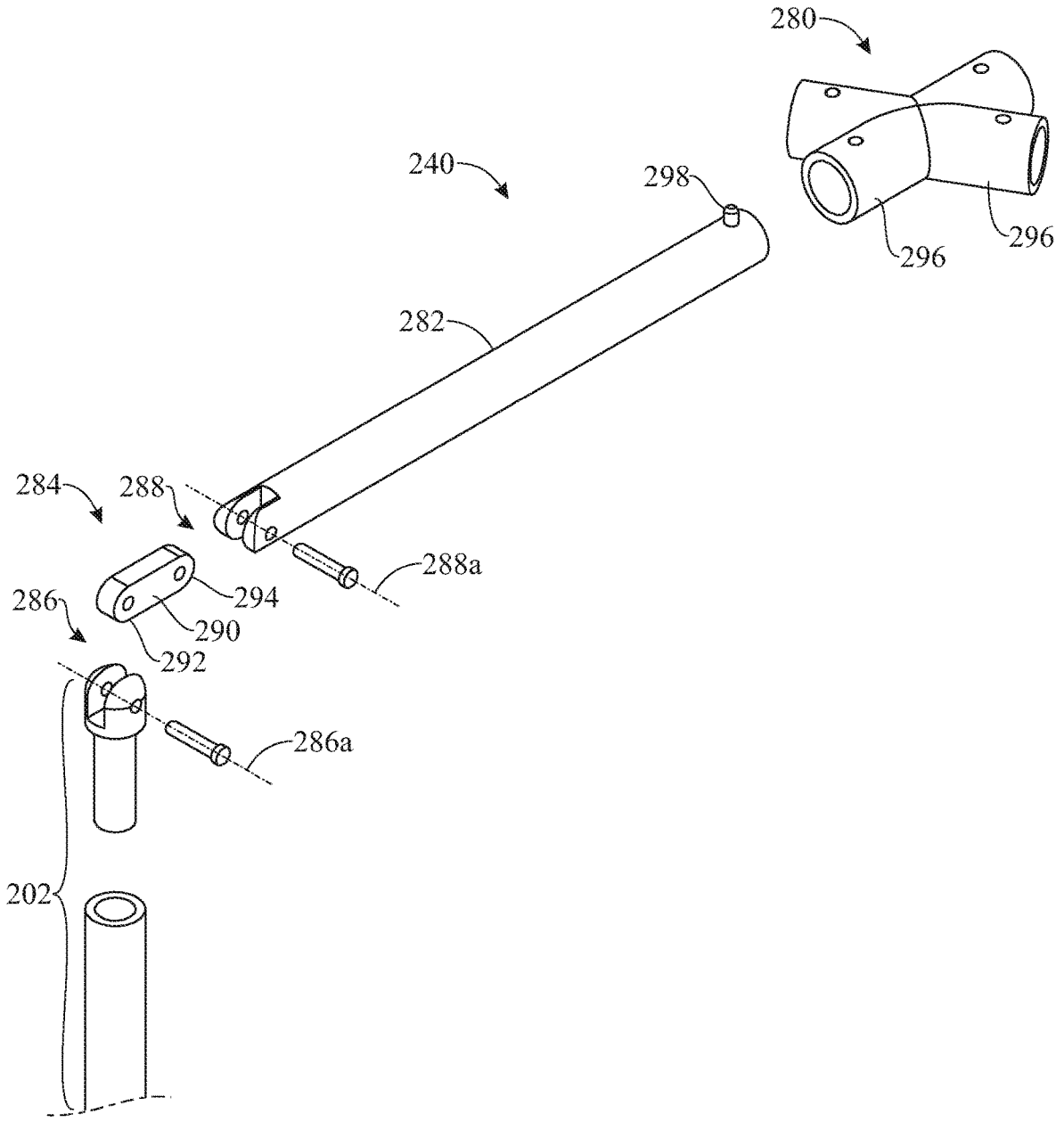
FIG. 9 presents a partial, exploded, top isometric view of a hub and one of the pivotable bracket members of the stiffening bracket, the hub and pivotable bracket member shown together with a corresponding articulated connection and elongated support member.
Figure 10:
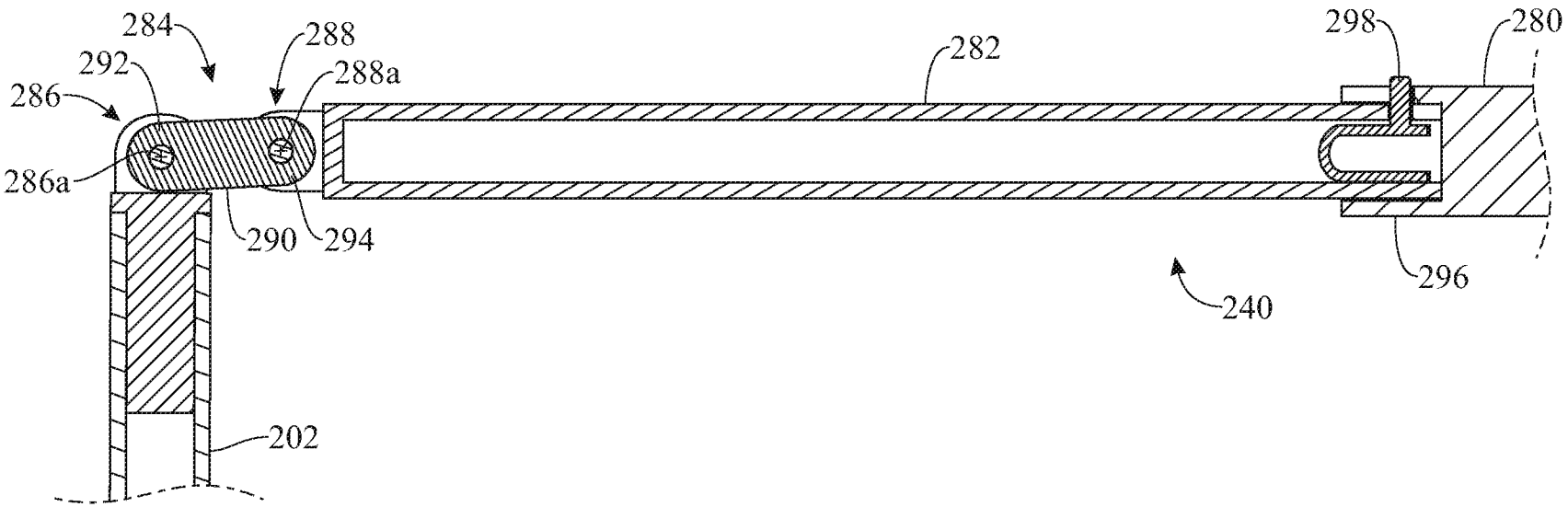
FIG. 10 presents a cross-sectional, side elevation view of the elements of FIG. 9, shown assembled, with the section taken along section plane 10-10 indicated in FIG. 8.

As further shown in FIGS. 9 and 10, the hub 280 is disconnectably connectable to the plurality of pivotable bracket members 282. In some examples, the hub 280 may include a plurality of connectors 296, wherein each connector 296 is configured to disconnectably connect to a respective one of the pivotable bracket members 282. In some embodiments, such as the present embodiment, the connectors 296 may be female connectors configured to receive the respective pivotable bracket member 282, as best shown in FIG. 10. However, alternative embodiments are contemplated, such as having the hub include male connectors fit into female-type pivotable bracket members. In some embodiments, one or more releasable fasteners may secure the connectors 296 to the pivotable bracket member 282. For example, in the present embodiment, each connector 296 of the huh 280 is secured to the corresponding pivotable bracket member 282 by a quick-release, spring-loaded pin 298 which extends through the male-type connector 296 and is operable (inwardly depressable) from outside. In the absence of any or a sufficient pushing force on the pin 298, the spring-loaded pin 298 is biased to extend through both the pivotable bracket member 282 and the connector 296, thereby preventing relative movement between (and thus disconnecting of) the pivotable bracket member 282 and the connector 296. In order to disengage the pivotable bracket member 282 and the connector 296, a user may push the spring-loaded pin 298 sufficiently inward to release the connector 296 and allow the connector 296 to move relative to the pivotable bracket member 282. Furthermore, the pin 298 may have rounded edges to facilitate engaging the connector 296 with the pin 298 by simply sliding the connector over the pin 298. In other embodiments, alternative or additional fastening members such as, but not limited to, a magnet, snap fastener, threaded connection, or frictional fit may be used to disconnectably connect the pivotable bracket member 282 to the connector 296 without departing from the scope of the present disclosure.

The enclosure 214 comprises one or more storage compartments 252 formed therein, configured to store one or more personal items, as has been described heretofore with reference to enclosure 114 and compartments 152. For instance, similarly to the previous embodiment, each elongated support member 202 may extend through a respective pair of support member openings 226 arranged at the periphery of the enclosure when the storage device is in the assembled configuration. Similarly to the previous embodiment, the one or more storage compartments 252 may include a plurality of storage compartments 252, and a plurality of shelf panels may be arranged within the enclosure 214, separating the storage compartments 252 from each other. Alternatively or additionally, the enclosure 214 may include at least one see-through window configured to allow viewing at least one storage compartment 252 from outside the enclosure 214.

Figure 12:
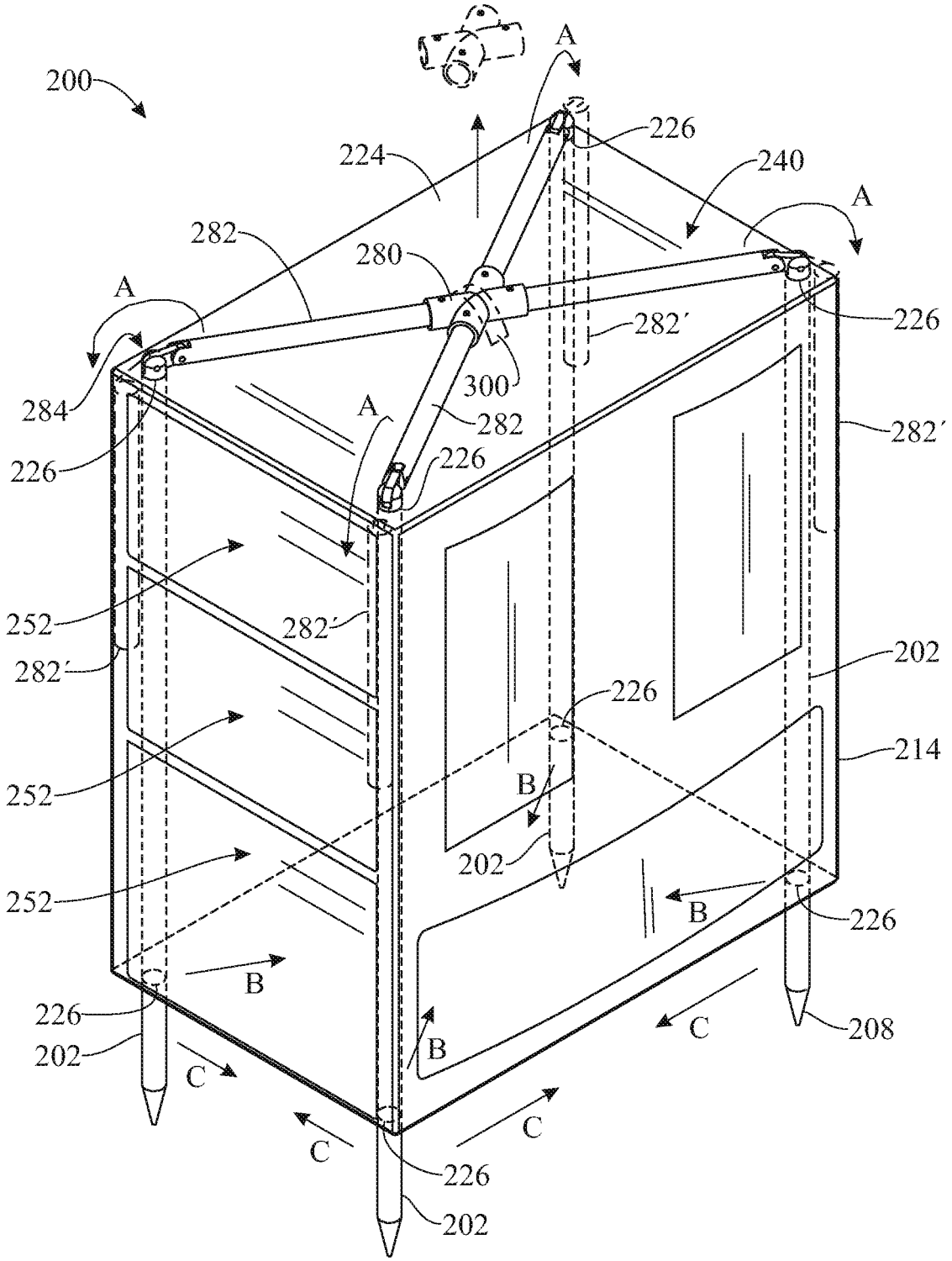
FIG. 12 presents a top isometric view of the beach caddy in accordance with the second illustrative embodiment of the invention, the drawing further showing the enclosure carried by the elongated support members and stabilized by the stiffening bracket.

The beach caddy 200 is configured to adopt an assembled configuration, best shown in FIG. 12. In the assembled configuration, the elongated support members 202 are arranged vertically and parallel to one another and are coupled to, attached to, or engaged with the enclosure 214. The pivotable bracket members 282 are pivoted towards the hub 280; for example, each pivotable bracket member 282 may be pivotally arranged generally perpendicular to the respective elongated support member 202. The hub 280 is disconnectably connected to the pivotable bracket members 282. The stiffening bracket 240 may be arranged generally perpendicular to the plurality of elongated support members 202, as shown, and disconnectably interconnects the elongated support members 202, rigidly maintaining the elongated support members 202 in a spaced-apart configuration from each other (i.e. preventing the elongated support members 202 from moving towards each other). The elongated support members 202 in the spaced-apart configuration, as maintained by the stiffening bracket 240, in turn maintain the enclosure 214 in a deployed position as shown in the figure. In this deployed position of the enclosure 214, the one or more storage compartments 252 of the enclosure 214 provide respective one or more spaces for item storage. Tapered insertion tips 208 may terminate the elongated support members 202 to facilitate insertion of the elongated support members 202 into the sand, for instance and without limitation.

As further shown in FIG. 12, similarly to the previous embodiment, when the beach caddy 200 is in the assembled configuration, the enclosure 214 may be arranged beneath the stiffening bracket 240, and a top 224 of the enclosure 214 may be disconnectably suspended from the stiffening bracket 240 (e.g., from the hub 280). For example, one or more fasteners 300 may be provided on the top 224 of the enclosure 214 and may be configured to releasably engage the stiffening bracket 240, and more preferably, the hub 280. In some embodiments, the one or more fasteners 300 may include one or more strings, ropes, hooks, brands, or straps which may be tied to one another, tied to the hub 280, and/or provided with one or more of a hook-and-loop fastener, a snap fastener, a magnetic fastener, a button, or other applicable fastening means.

Similarly to the previous embodiment, the elongated support members 202 may be arranged at a periphery of the one or more storage compartments 252 when the storage device is in the assembled configuration of FIG. 12. I.e., the elongated support members 202 may be located radially outward of the one or more storage compartments 252. For example, as shown in FIG. 12, the elongated support members 202 may be coupled to a periphery of the enclosure 214 when the storage device is in the assembled configuration.

Figure 11:
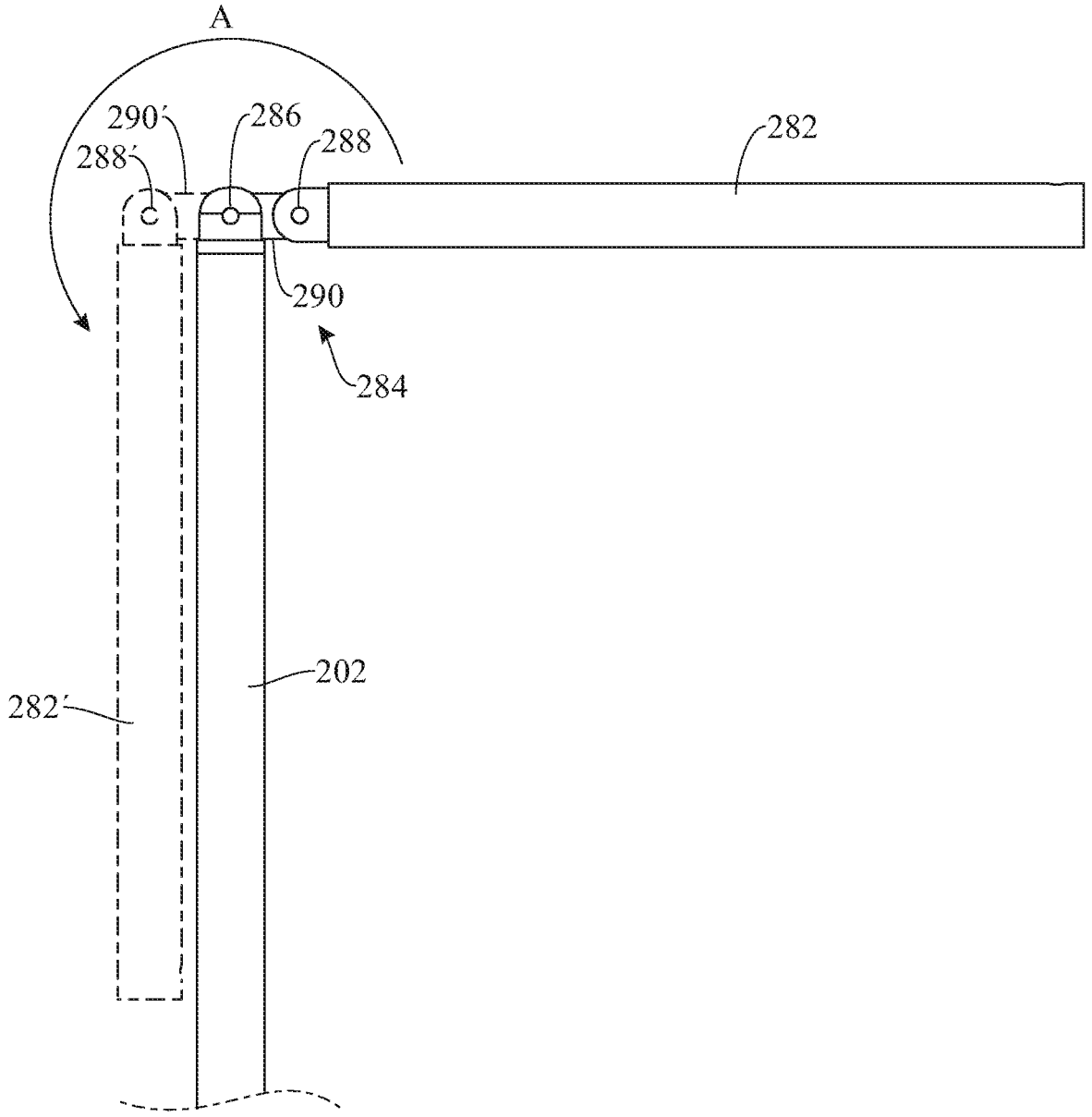
FIG. 11 presents a side elevation view of the elements of FIG. 9, shown assembled, wherein the pivotable bracket member is shown in two alternative positions relative to the elongated support member.

With reference to FIGS. 11 and 12, the pivotable bracket member 282 of the present embodiment may be disconnected from the hub 280 and pivoted outward, as indicated by arrows A, to a storage position depicted in phantom lines and indicated with reference numeral 282'; it must be noted that, alternatively, this action may be carried out with the hub 280 remaining connected to one of the pivotable bracket members 282. As the pivotable bracket member 282 is pivoted outward, the second pivoting connection 288 pivots outward about the rotation axis 286*a* of the first pivoting connection 286, allowing the second pivoting connection 288 and connecting link 290 to achieve an outer position, indicated by reference numerals 288' and 290', respectively, which in turn allows the pivotable bracket member 282' to become suspended generally parallel to and side-by-side with the corresponding elongated support member 202 to which the pivotable bracket member 282 is pivotably attached, thereby minimizing the volumetric space required to store the elongated support members 202 and pivotable bracket members 282. In some embodiments, such as the present embodiment, the pivotable bracket members 282 may be formed as elongate bodies (e.g., tubes, poles, rods, etc.), similarly to the elongated support members 202. Having the pivotable bracket members 282 elongately formed allows to minimize the size of the hub 280 and thus the required volumetric space for storing the beach caddy 200 when not in use, as both the hub 280 and the pivotable bracket members 282 (especially if pivoted against the elongated support members 202) will occupy a minimal amount of space.

With continued reference to FIG. 12, once each pivotable bracket member 282 is pivoted outward and positioned adjacent to the respective elongated support member 202, as indicated with reference numerals 282', the elongated support members 202 (which are no longer interconnected by the stiffening bracket 240) may be moved closer to one another, as indicated by arrows B. Should the enclosure 214 continue to be attached to or engaged with the elongated support members 202, in bringing the elongated support members 202 closer to one another, the enclosure 214 will collapse as indicated by arrows C; in consequence, a collapsed beach caddy, comprising the more proximate elongated support members 202 and pivotable bracket members 282 and the collapsed enclosure 214, is obtained which may be stored in a relatively small volumetric space. In some embodiments, alternatively or additionally, the elongated support members 202 may be removed from the enclosure 214, allowing the elongated support members 202 and pivotable bracket members 282 to be folded and the enclosure 214 to be collapsed, and optionally stored, separately from one another.

In summary, the storage device disclosed herein can provide is a lightweight, portable, collapsible storage unit for use at the beach or other location. The storage device is designed to hold one's personal items and other items which may be taken, for instance, to the beach, helping solve the problem of space on the beachgoer's towel or blanket being taken by personal items or other objects, and also allowing to keep the personal items and other objects sand free. The storage device can remain sturdy on a windy day, as the support frame structure is maintained relatively rigid by the stiffening bracket.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A storage device, suitable to facilitate storage of one or more items of a user at the beach or other location, comprising:

a support frame comprising a plurality of elongated support members and a stiffening bracket, the stiffening bracket comprising a hub and a plurality of pivotable bracket members, wherein the hub is disconnectably and non-pivotably connectable to the plurality of pivotable bracket members, and wherein each pivotable bracket member of the plurality of pivotable bracket members is pivotably connected to a respective elongated support member of the plurality of elongated support members; and an enclosure, wherein the enclosure is foldable and attachable to the support frame and comprises one or more storage compartments formed therein; wherein the storage device is configured to selectively adopt:

an assembled configuration in which the elongated support members are attached to the enclosure, and further in which the pivotable bracket members are pivoted relative to the respective elongated support members such that the pivotable bracket members extend towards each other, and further in which the hub is non-pivotably connected to the pivotable bracket members such that the stiffening bracket rigidly maintains the elongated support members in a spaced-apart configuration from each other, wherein the elongated support members in the spaced-apart configuration maintain the enclosure in a deployed position in which the one or more storage compartments provide respective one or more spaces for item storage, and a storage configuration, in which the pivotable bracket members are disconnected from the hub, and further in which each pivotable bracket member is pivotally arranged in a generally parallel and side-by-side relationship with the respective elongated support member.

2. The storage device of claim 1, wherein the elongated support members are arranged at a periphery of the one or more storage compartments when the storage device is in the assembled configuration.

3. The storage device of claim 1, wherein the elongated support members are coupled to a periphery of the enclosure when the storage device is in the assembled configuration.

4. The storage device of claim 3, wherein each elongated support member extends through a respective pair of support member openings arranged at the periphery of the enclosure when the storage device is in the assembled configuration.

5. The storage device of claim 1, wherein the elongated support members are arranged vertically and parallel to one another when the storage device is in the assembled configuration.

6. The storage device of claim 1, wherein the elongated support members comprise a respective tapered insertion tip at a lower end thereof.

7. The storage device of claim 1, wherein, when the storage device is in the assembled configuration, the enclosure is arranged beneath the stiffening bracket.

8. The storage device of claim 7, wherein, when the storage device is in the assembled configuration, a top of the enclosure is disconnectably suspended from the stiffening bracket.

9. The storage device of claim 1, wherein, when the storage device is in the assembled configuration, said each pivotable bracket member is pivotally, arranged generally perpendicular to the respective elongated support member and the stiffening bracket is arranged generally perpendicular to the plurality of elongated support members.

10. The storage device of claim 1, wherein, when the storage device is in the assembled configuration, a top of the enclosure is disconnectably, suspended from the hub.

11. The storage device of claim 1, wherein the plurality of elongated support members comprises four elongated support members, and the plurality of pivotable bracket members comprises four pivotable bracket members, wherein each bracket member of the four pivotable bracket members is pivotably carried by a respective elongated support member of the four elongated support members, and further wherein the hub is X-shaped.

12. The storage device of claim 1, wherein the one or more storage compartments comprise a plurality of storage compartments, the storage device further comprising a plurality of shelf panels arranged within the enclosure and separating the storage compartments from each other.

13. The storage device of claim 1, wherein, when the storage device is arranged in the storage configuration, the elongated support members are not interconnected by the stiffening bracket and are closer to one another than in the assembled configuration.

14. The storage device of claim 13, wherein, when the storage device is arranged in the storage configuration, the elongated support members are attached to the enclosure and the enclosure is collapsed.

* * * * *